US005334055A

United States Patent [19]

Sato et al.

[11] Patent Number: 5,334,055

[45] Date of Patent: Aug. 2, 1994

[54] ELECTRICAL CONNECTOR

[75] Inventors: Kensaku Sato; Akira Shirai, both of Tokyo, Japan

[73] Assignee: Hirose Electric Co., Ltd., Tokyo, Japan

[21] Appl. No.: 870,110

[22] Filed: Apr. 17, 1992

Related U.S. Application Data

[63] Continuation of Ser. No. 715,805, Jun. 14, 1991, abandoned.

[30] Foreign Application Priority Data

Sep. 18, 1990 [JP] Japan ..... 2-97251[U]
Sep. 18, 1990 [JP] Japan ..... 2-97253[U]

[51] Int. Cl.[5] ..... H01R 11/09
[52] U.S. Cl. ..... 439/723; 439/578
[58] Field of Search ..... 439/578-585, 439/916, 675, 63, 581, 744, 746, 747; 343/876, 893

[56] References Cited

U.S. PATENT DOCUMENTS 2,625,591 1/1953 George ..... 343/876
2,659,001 11/1953 Thorne ..... 343/876
2,901,748 8/1959 Sirons ..... 343/876
3,302,159 1/1967 Schumacher ..... 439/675
4,732,568 3/1988 Hall ..... 439/676
4,747,786 5/1988 Hayashi et al. ..... 439/578
4,813,888 3/1989 Tokizane et al. ..... 439/578
4,846,719 7/1989 Iwashita ..... 439/63
4,859,197 8/1989 Toramoto et al. ..... 439/675

*Primary Examiner*—David L. Pirlot
*Attorney, Agent, or Firm*—Kanesaka & Takeuchi

[57] ABSTRACT

An electrical connector with an antenna terminal includes an insulation housing (4) having a base portion (4a) with at least one mounting hole (6); an antenna terminal insulation column (9) extending forwardly from the base portion and having a central aperture (14) therethrough; and an outer conductor terminal (22) having a cylindrical terminal body (23) fitted over the antenna terminal insulation column and a conductor portion (24) extending outwardly from a lower edge of the terminal body and having a ring portion (25) which is placed on the mounting hole for attachment to a grounding object.

3 Claims, 10 Drawing Sheets

ELECTRICAL CONNECTOR

CROSS-REFERENCE TO RELATED APPLICATIONS

This is a continuation application of Ser. No. 715,805 filed Jun. 14, 1991 now abandoned.

BACKGROUND OF THE INVENTION

1. Field of the Invention

The present invention relates to electrical connectors for establishing contacts between antenna connection terminals and between contact terminals.

2. Description of the Prior Art

Electrical connectors of this type are used to connect cables for transmitting signals to receivers from antennas which are mounted on moving objects such as automobiles. However, most of the conventional electrical connectors are used to connect a cable of a single antenna to a receiver.

FIG. 23 shows such a conventional male connector 80 which includes an insulation housing 82 with a fitting cavity 83 having a pair of insulation walls 84. An antenna terminal mount 85 is provided on the upper left-hand corner of the insulation housing 82. A number of male terminals 86 are mounted at predetermined intervals on opposite sides of each insulation walls 84 for serving as signal terminals or power terminals. An antenna male terminal 87 is mounted on the antenna terminal mount 85. The antenna male terminal 87 has a male central conductor 100 and a resilient male outer conductor 101 surrounding the male central conductor 100.

In FIG. 24, the central conductor 101 and the outer conductor 102 are connected to the central conductor 103 and the outer conductor 104 of a shielded cable on the rear side of the male connector 80.

In FIG. 25, the male connector 80 is attached to a panel 89 by inserting the housing 82 through an opening 89*a* of the panel 89 and screwing a bolt 90*a* into a embedded fixture 87*a* with a rug washer 87*b* placed between the housing 82 and the panel 89. A board 88 is then attached to the housing 82 by tightening a nut 90*b*. The front end of the rug washer 87*b* is connected to the outer conductor 102 of the male terminal 87 via a lead wire 105 for grounding.

In FIG. 26, a conventional female connector 81 includes an insulation housing 91 with two pairs of insulation walls 92. A number of female terminals 93 are mounted at predetermined intervals on the inner sides of each pair of insulation walls 92 for serving as power terminals or signal terminals. An antenna terminal mount 94 is provided on the upper right-hand corner of the insulation housing 91. An antenna female terminal 95 is mounted in the antenna terminal mount 94. The antenna female terminal 95 has a female central conductor 106 and a female outer conductor 107.

When the female connector 81 is connected to the male connector 80, the insulation walls 92 of the female connector 81 are fitted into the fitting cavity 83 of the male connector 80 so that the signal terminals and the power terminals of the female connector 81 are brought into contact with those of the male connector 80 while the antenna female terminal 94 is brought into contact with the antenna male terminal 87.

However, it is very difficult and expensive to connect the male outer conductor 102 to the panel 89 for grounding because the lead wire 105 must be soldered to the rug washer 87*b* which is secured between the panel 89 and the housing 82 with a bolt 90*a* and the embedded fixture 87*a*. In addition, it often causes poor connection.

SUMMARY OF THE INVENTION

Accordingly, it is an object of the invention to provide an inexpensive yet reliable electrical connector which has at least one antenna terminal.

According to one aspect of the invention there is provided an electrical connector with an antenna terminal which includes an insulation housing having a base portion with at least one mounting hole; an antenna terminal insulation column extending forwardly from the base portion and having a central aperture therethrough; and an outer conductor terminal having a cylindrical terminal body fitted over the antenna terminal insulation column and a conductor portion extending outwardly from a lower edge of the terminal body and having a ring portion which is placed on the mounting hole for attachment to a grounding object.

According to another aspect of the invention there is provided an electrical connector with an antenna terminal, which includes an insulation housing having a base portion and a fitting block extending forwardly from the base portion and having at least one fitting recess; at least one antenna terminal mount formed in the fitting block and having an insulation column with a central aperture therethrough; an inner conductor terminal fitted into the central aperture; and an outer conductor terminal having a cylindrical body portion fitted into the terminal mount and a shield connection portion to which a shield wire of a shielded cable is connected.

With the electrical connector according to the invention it is possible to reduce the number of components and eliminate soldering the rug washer to a grounding conductor.

The above and other objects, features, and advantages of the invention will be more apparent from the following description when taken in conjunction with the accompanying drawings.

DESCRIPTION OF THE PREFERRED EMBODIMENT

Figure 1:
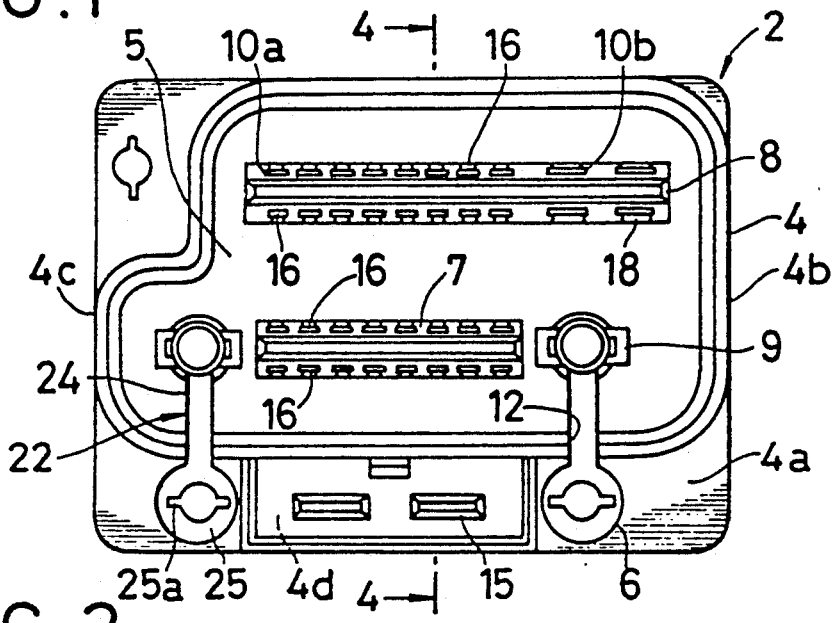
FIG. 1 is a top plan view of a male electrical connector for a multiple antenna according to an embodiment of the invention.
Figure 2:
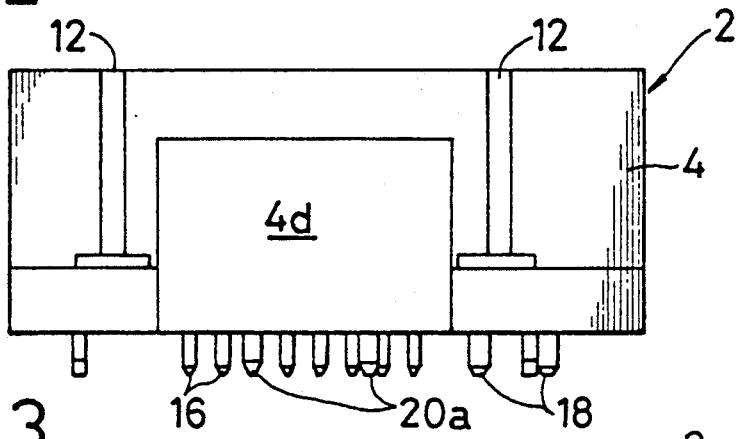
FIG. 2 is a front elevational view thereof.
Figure 3:
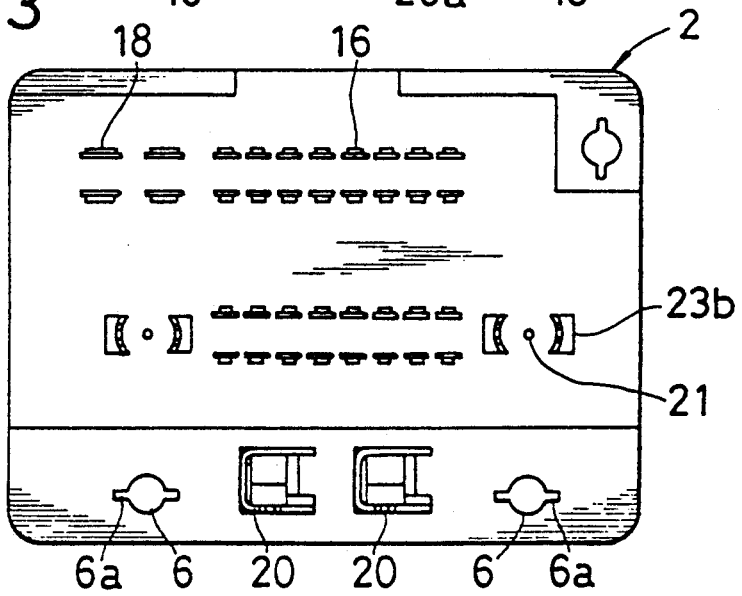
FIG. 3 is a bottom plan view thereof.

In FIGS. 1–4, a male connector 2 includes an insulation housing 4 which has a rectangular base 4*a* and a side wall 4*b* for defining a fitting cavity 5. The side wall 4*b* has an expanded section 4*c* making the fitting cavity 5 asymmetric. A fuse mount 4*d* is provided on the rectangular base 4*a* in front of the fitting cavity 5 and is made lower than the side wall 4*b*. A pair of mounting apertures 6 with a pair of slits 6*a* are provided on the rectangular base 4*a* across the fuse mount 4*d*. A short insulation wall 7 and a long insulation wall 8 extend upwardly from the rectangular base 4*a* and parallel with each other. A pair of antenna terminal mounts 9 are provided on the rectangular base 4*a* across the short insulation wall 7.

The leg portion 20*a* of the fuse terminal 20 is soldered to the power circuit conductor of a board. A fuse (not shown) is mounted on the fuse mount 4*d* of the male connector 2 by inserting its leg portion into the terminal apertures 15 so that they comes into contact with the fuse terminals 20. 16 signal terminal channels 10*a* and four power terminal channels 10*b* are formed at predetermined intervals on opposite sides of the long insulation wall 8 for receiving male signal contact terminals 16 and male power contact terminals 18, respectively, while 16 signal terminal channels 10*a* are formed at predetermined intervals on opposite sides of the short insulation wall 7 for receiving male signal contact terminals 16. The side wall 4*b* discontinues at a pair of openings 12 on the lines which include the antenna terminal mounts 9 and the mounting apertures 6.

Figure 4:
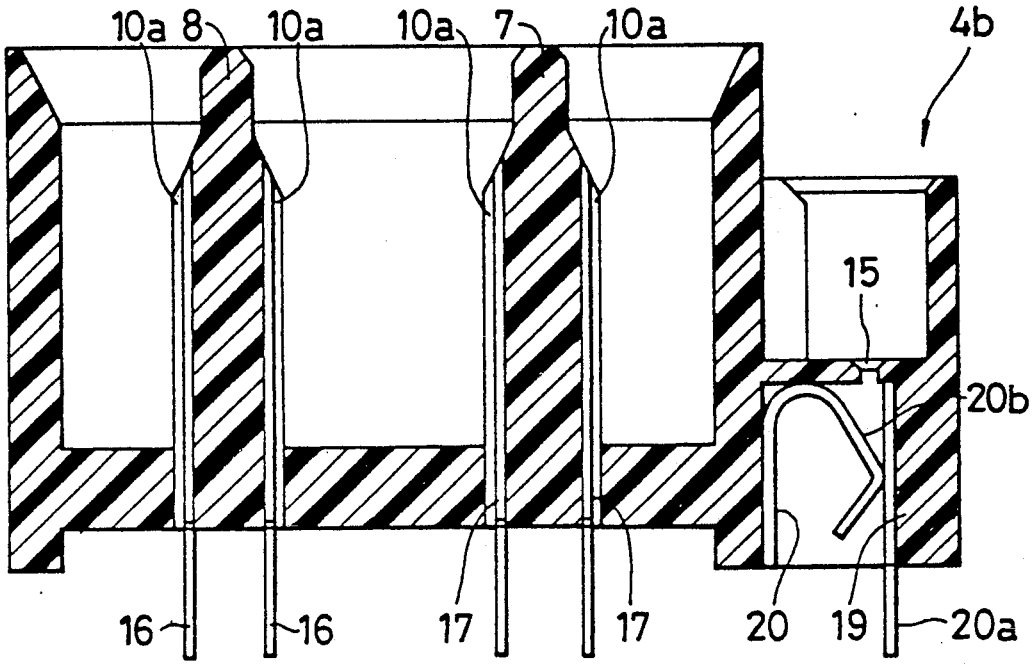
FIG. 4 is a sectional view taken along line 4—4 of FIG. 1.

As best shown in FIG. 4, the terminal channels 10*a* communicate with press fit apertures 17 in the rectangular base 4*a*. The male signal terminals 16 are fitted into the press fit apertures 17. A terminal mount 19 is provided on the bottom of the fuse mount 4*d* for receiving the fuse terminal 20.

Figure 5:
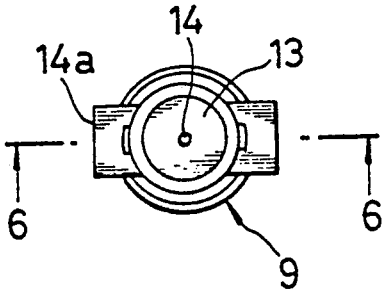
FIG. 5 is a top plan view of an antenna terminal mount for the male electrical connector.
Figure 6:
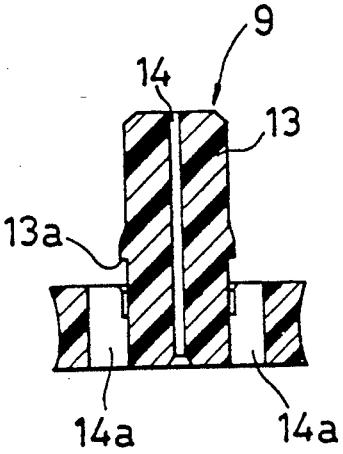
FIG. 6 is a sectional view taken along line 6—6 of FIG. 5.

In FIGS. 5 and 6, the antenna terminal mount 9 includes an antenna terminal insulation column 13 which has a male central conductor aperture 14 for receiving the central conductor of a shielded cable and a pair of hooks 13*a* on the base portion. A pair of openings 14*a* are formed on opposite sides of the insulation column 13.

Figure 7:
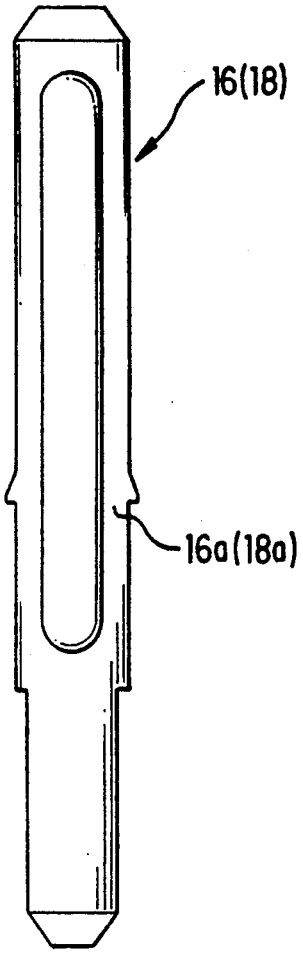
FIG. 7 is a top plan view of a signal or power male terminal for the male electrical connector.
Figure 8:
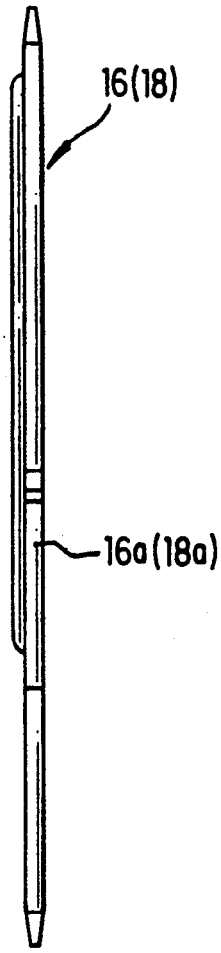
FIG. 8 is a side elevational view thereof.

In FIGS. 7 and 8, the signal or power contact terminal 16, 18 which is to be fitted in the terminal channel 10*a*, 10*b* has a press fit portion 16*a*, 18*a* to be press fitted into the press fit aperture 17. The width of the power contact 18 is made larger than that of the signal terminal 16.

Figure 9:
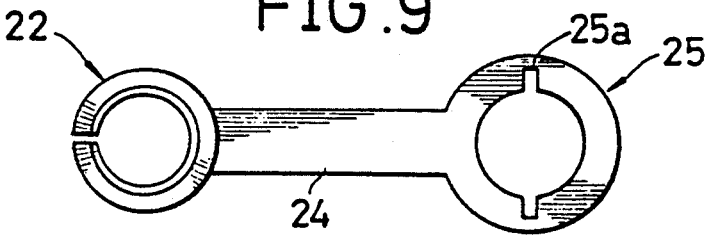
FIG. 9 is a top plan view of a male antennas outer conductor terminal for the male electrical connector.
Figure 11:
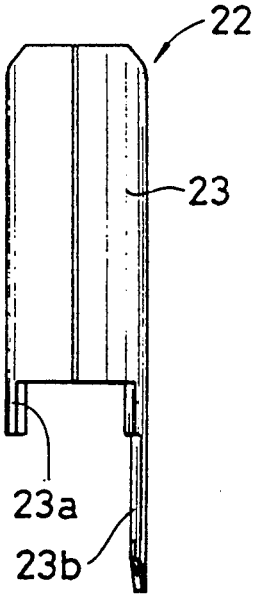
FIG. 11 is a rear elevational view thereof.
Figure 10:
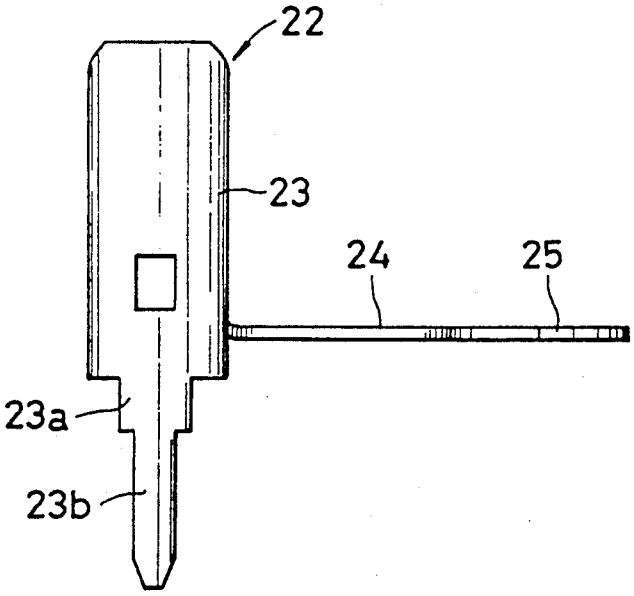
FIG. 10 is a side elevational view thereof.

In FIGS. 9–11, the male antenna outer conductor terminal 22 has a cylindrical terminal body 23 which has press-fit portion 23*a* and a leg portion 23*b*. A conductor portion 24 extends laterally from the terminal body 23 and terminates with a ring portion 25 having an attachment hole 25*b* with a pair of opposed slits 25*a*. The outer conductor terminal 22 is mounted on the insulation housing 4 by fitting the terminal body 23 over the antenna insulation column 13 while press fitting the press-fit portion 23*a* in the opening 14*a*. At the same time, the conductor portion 24 is fitted in the opening 12 of the side wall 4*b* while the ring portion 25 is placed on the mounting aperture 6 as shown in FIG. 1.

Figure 12:
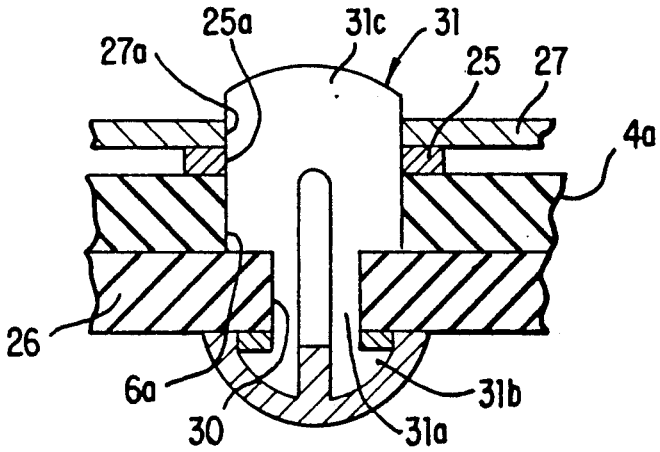
FIG. 12 is a sectional view of a mounting aperture of the male electrical connector.

In FIG. 12, the male connector 2 and a board 26 are mounted on a panel 27 by inserting the side wall 4*b* of the insulation housing 4 into an opening of the panel 27 so that the housing base 4*a* is brought into contact with the panel 27, fitting the conductor portion 24 of the antenna male terminal 22 in the opening 12 of the side wall 4*b* such that the ring portion 25 of the antenna male terminal 22 is placed on the mounting aperture 6 of the base portion 4*a*. Thus, the panel opening, the ring portion 25, and the mounting aperture 6 are aligned, with the slits 25*a* and 6*a* also aligned. Then, the board 26 is placed upon the housing base 4*a* such that the aperture 30 of the board 26 is aligned with the mounting aperture 6 of the housing base 4*a*. Then, planar clip 31 is inserted into the ring portion 25 and the mounting apertures 6 and 30 such that the head 31*c* fits in the slits 25*a* and 6*a* while the leg portion 31*a* comes into contact with the ground conductor of the board 26 with the return portion 31*b*. Then, the return portion 31*b* is soldered to the ground conductor to secure the male connector 2 and the board 26 to the panel 27.

Figure 13:
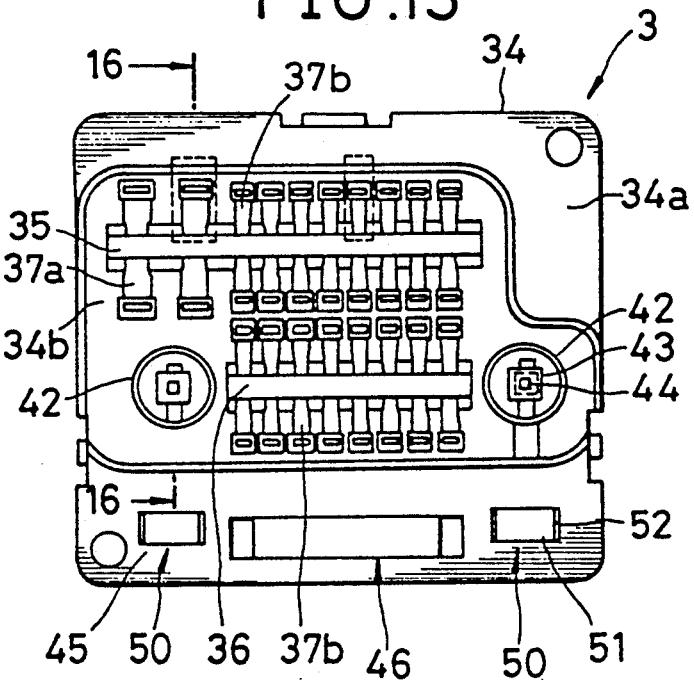
FIG. 13 is a top plan view of a female electrical connector according to an embodiment of the invention.
Figure 14:
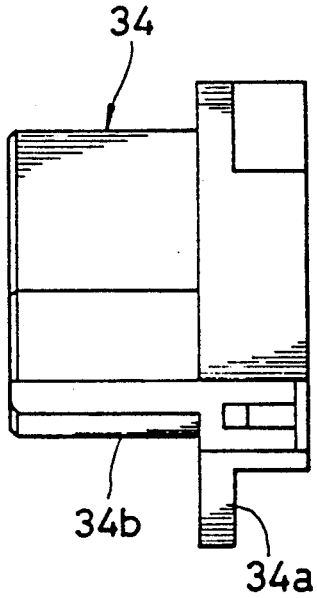
FIG. 14 is a side elevational view thereof.
Figure 15:
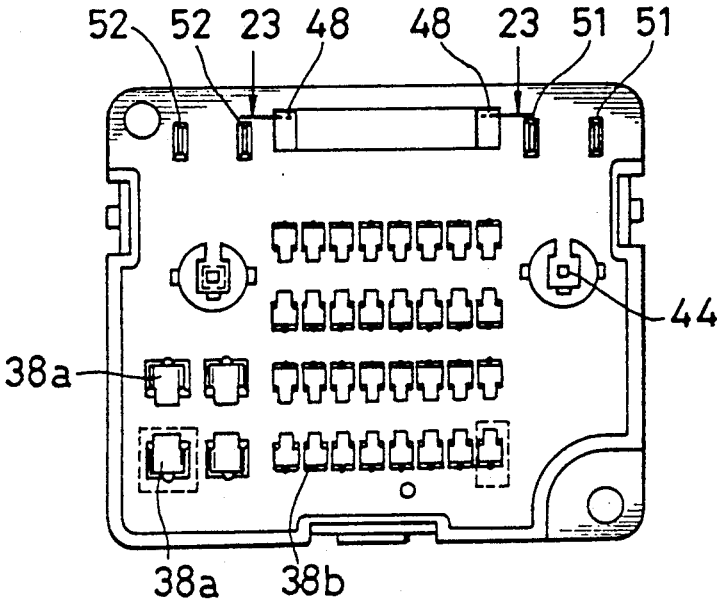
FIG. 15 is a bottom plan view thereof.

In FIGS. 13–15, the female connector 3 includes an insulation housing 34 which has a housing base 34*a* and a fitting block 34*b* with a long fitting recess 35 and a short fitting recess 36. Four power terminal channels 37*a* and 16 signal terminal channels 37*b* are formed on opposite sides of the long fitting recess 35 at predetermined intervals, and 16 signal terminal channels 37*b* are formed on opposite sides of the short fitting recess 36 at predetermined intervals. A pair of antenna terminal mounts 42 are formed across the short fitting recess 36 on the fitting block 34*b*. The antenna terminal mounts 42 have an antenna terminal insulation column 43 which has a central aperture 44.

Figure 16:
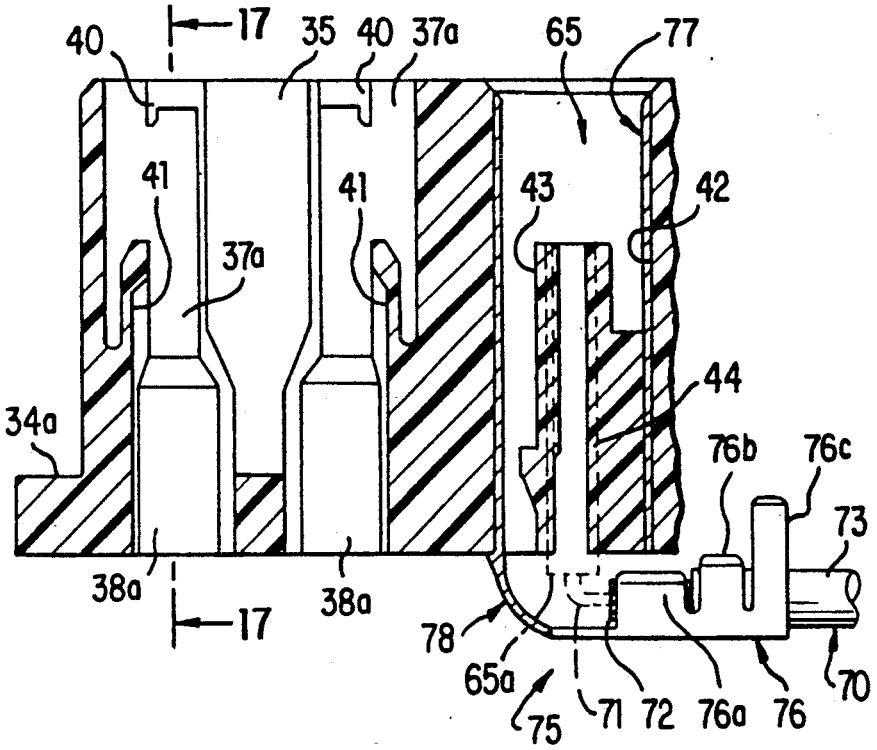
FIG. 16 is a sectional view taken along line 16—16 of FIG. 13.
Figure 17:
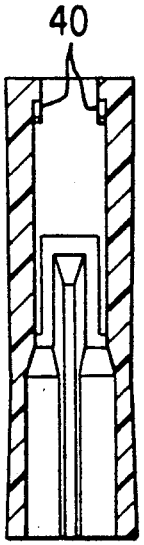
FIG. 17 is a sectional view taken along line 17—17 of FIG. 16.

In FIGS. 16 and 17, the terminal channels 37*a* communicate with terminal press fit apertures 38*a* at the bottom of the fitting recess 35. A pair of terminal supports 40 are provided at opposite sides of the front end of each terminal channel 37*a*. A lance 41 extends forwardly from the middle of each terminal channel 37*a*. The antenna terminal mounts 42 have a columnar portion 43 which has an antennas terminal receiving aperture 44.

Figure 18:
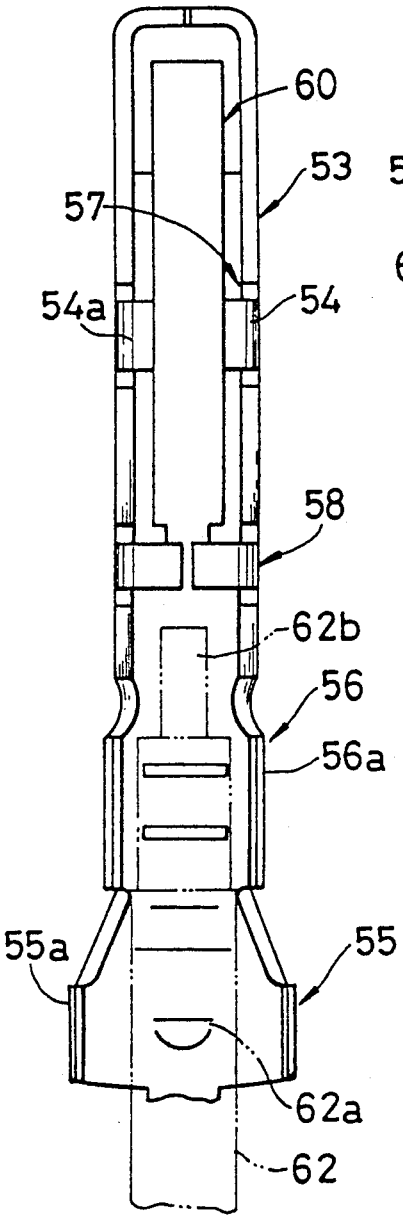
FIG. 18 is a top plan view of a female contact terminal for the female electrical connector.
Figure 19:
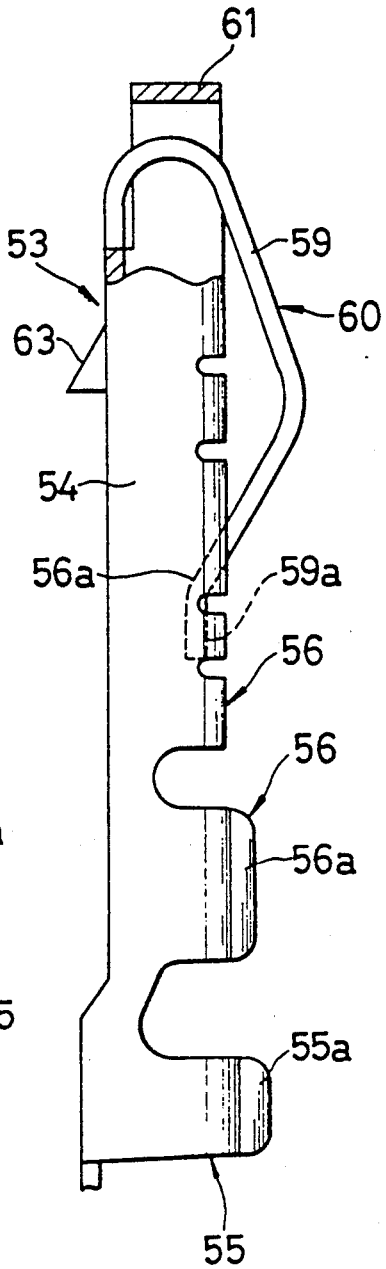
FIG. 19 is a side elevational view thereof.
Figure 20:
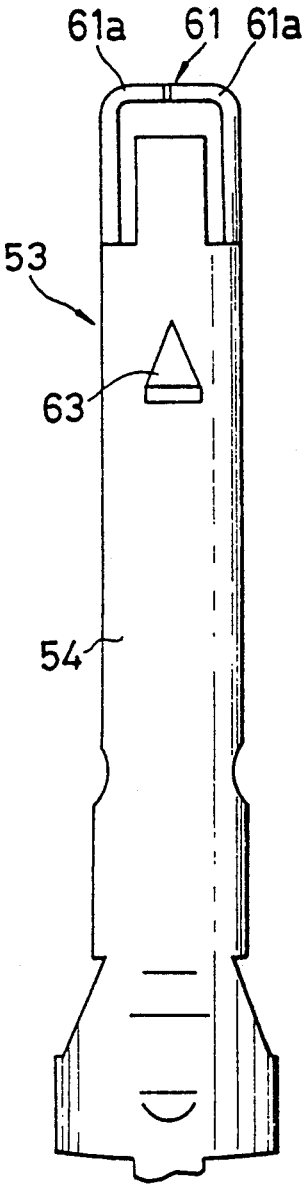
FIG. 20 is a bottom plan view thereof.

In FIGS. 18–20, a female terminal 53 has a substantially U-shaped terminal body 54 with a U-shaped sheath crimping portion 55 and a U-shaped central conductor crimping portion 56. The sheath crimping portion 55 has a pair of crimping tabs 55*a* while the central conductor crimping portion 56 has a pair of crimping tabs 56*a*. The terminal body 54 has a pair of bent pieces 54*a* to form a stopper portion 57 and a similarly structured hook portion 58. The front strip portion 59 of the terminal body 54 is bent backwardly and then downwardly to form a V-shaped contact portion 60. The free end 59*a* thereof is engages the hook portion 58. The front ends 61*a* of opposite sides of the terminal body 54 are bent to form a support portion 61 which surrounds the contact portion 60 for protection.

The sheath crimping portion 55 and the central conductor crimping portion 56 are crimped to the sheath 62*a* and the central conductor 62*b* of a signal line 62. The terminal is then inserted into the terminal channel 37*b* through the terminal press fit aperture 38*b* until the front support portion 61 abuts on the terminal support portion 40. The lance 41 engages with the projection 63 of the terminal body 53*a*. The signal lines 62 connected to the female terminals 53 are bundled with a band 74 of the cable bundling section 46 to be described later.

Figure 21:
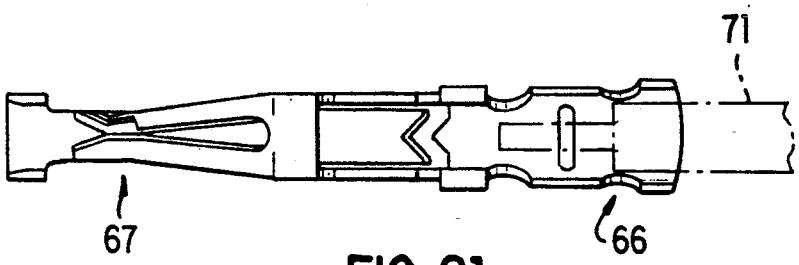
FIG. 21 is a top plan view of a female antennas inner conductor terminal for the female electrical connector.
Figure 22:
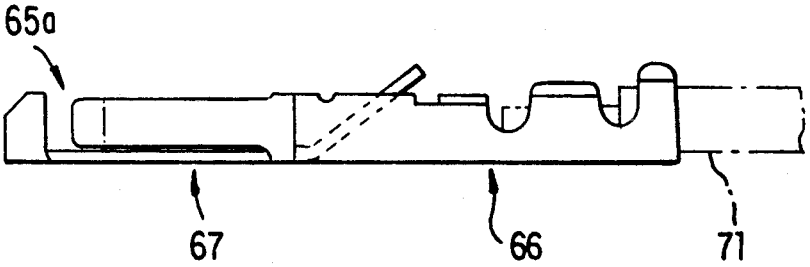
FIG. 22 is a side elevational view thereof.
Figure 23:
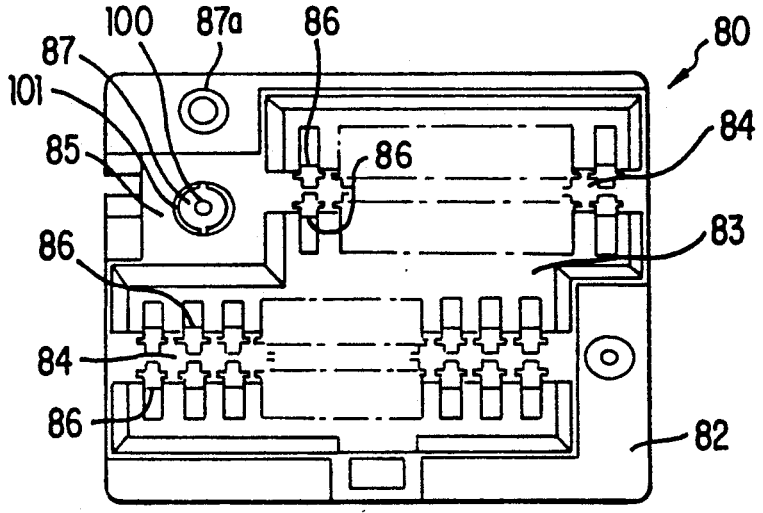
FIG. 23 PRIOR ART
FIG. 23 is a top plan view of a conventional male electrical connector.
Figure 24:
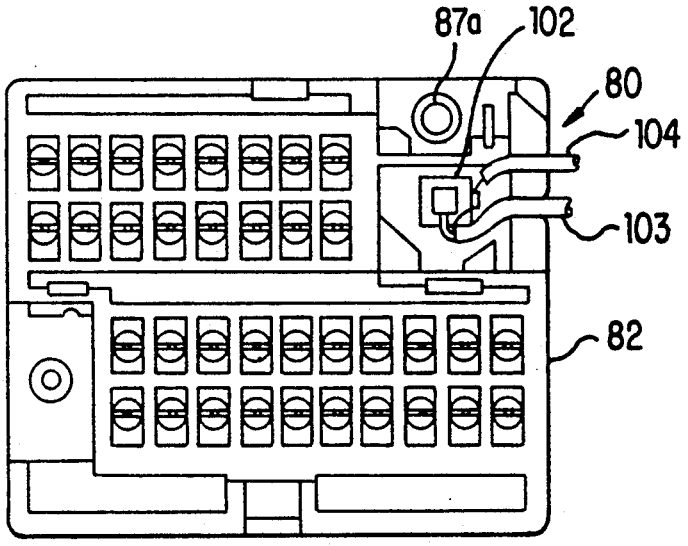
FIG. 24 PRIOR ART
FIG. 24 is a sectional view of a mounting aperture of the male electrical connector.
Figure 25:
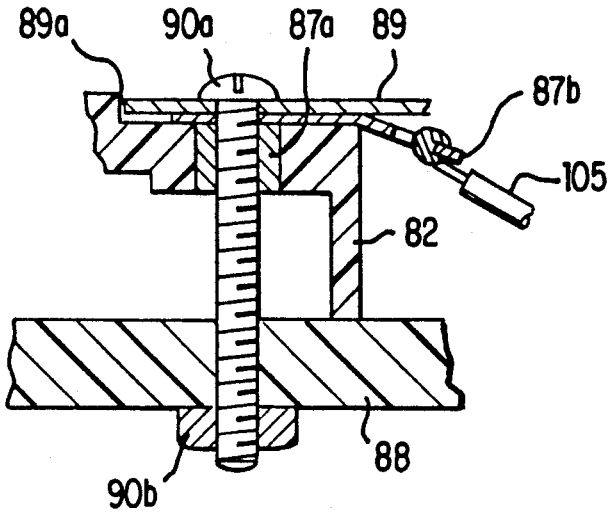
FIG. 25 PRIOR ART
FIGS. 25 and 26 are views of a conventional female electrical connector.
Figure 26:
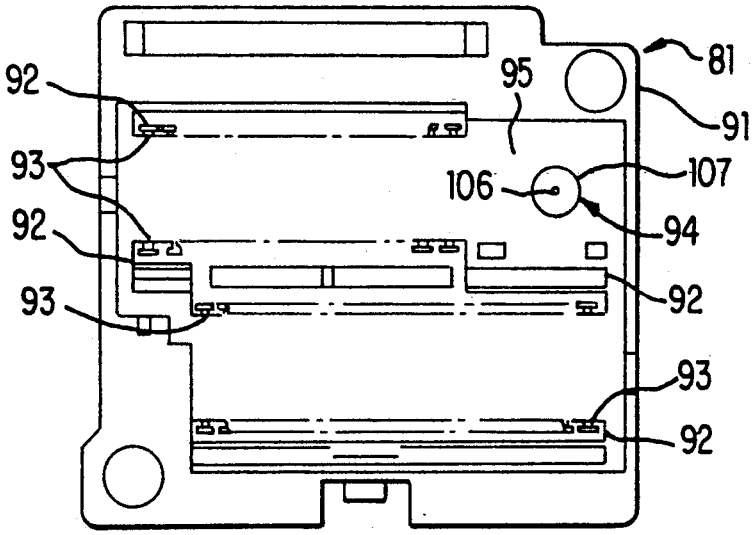
FIG. 26 PRIOR ART

In FIGS. 21 and 22, a central conductor 65*a*, which is inserted into the central hole 44 of the antennas terminal insulation column 43, has a connection portion 66 to which a central conductor 71 is connected and a resilient contact portion 67 for electrical contact with the central conductor 21 of a mating antenna male terminal. The central conductor 65*a* is then inserted into the central hole 44 from the back of the housing 34.

In FIG. 16, an outer conductor 75 is then inserted into the antenna terminal mount 42 from the back of the housing 34. The outer conductor 75 includes a cylindrical portion 77; an intermediate bent portion 78; and a conductor attachment portion 76 to which a shielded cable 70 is attached. The conductor attachment portion 76 has a shield crimping portion 76*a*, and an insulation jacket crimping portion 76*b*, and a securing portion 76*c* for securing the shielded cable 70 to the housing 34.

The male connector 2 and female connector 3 thus constructed are connected by fitting the fitting block 34*b* of the female connector 3 into the fitting cavity 5 of the male connector 2 so that the signal terminals and power terminals of both the connectors are brought into contact with each other while the antenna female terminal 65 is brought into contact with the antenna male terminal 22.

Since the front support portion 61 of the female terminal 53 is supported by the terminal support portion 40 of the terminal channel 38*b*, the female terminal 53 is prevented from flexing back, thus increasing the contact pressure. The support portion 61 surrounds the front end of the contact portion 60 for protection. There is the stopper 57 in the middle portion of the terminal body 54 so that the contact piece 59 abuts on the stopper 57 to prevent further deformation of the contact piece 59, thereby preventing flattening of the contact portion 60.

As has been described above, with the electrical connector according to the invention, it is possible to eliminate soldering as well as lead wires and rug washers, thereby making not only the number of components smaller but also the assembling operation easier than before, resulting in the increased reliability and the reduced manufacturing costs.

We claim:

1. An electrical connector with an antenna terminal, comprising:

an insulation housing having a base portion with a mounting hole thereon and a side wall extending upwardly from said base portion to define a fitting cavity;

an antenna terminal insulation column extending upwardly from said base portion within said fitting cavity and having a central aperture therethrough;

a slit provided on said side wall so as to extend upwardly from said base portioning a vertical plane which includes said mounting hole and said insulation column; and an outer conductor terminal having a cylindrical portion fitted over said insulation column, a conductor portion extending outwardly from a lower edge of said cylindrical portion and fitted in said slit of said side wall, and a ring portion placed on said mounting hole for attachment to a grounding object, thereby eliminating rug washer and soldering process.

2. The electrical connector of claim 1, wherein said outer conductor terminal has at least one press-fit portion extending downwardly from said cylindrical portion.

3. An electrical connector with an antenna terminal, comprising:

an insulation housing having a base portion and a fitting block extending forwardly from said base portion and having at least one fitting recess therein;

at least one antenna terminal mount formed in said block and having an insulation column with a central aperture therethrough;

an inner conductor terminal fitted into said central aperture and connected to a central conductor of a shielded cable; and an outer conductor terminal having a cylindrical portion fitted into said terminal mount, a shield connection portion connected to a shield wire of said shielded cable, and a securing portion for securing said shielded cable to said housing, thereby preventing excessive stresses from being applied to said outer terminal through said shielded cable.

* * * * *